US005774931A

United States Patent [19]

Coinon et al.

[11] Patent Number: 5,774,931

[45] Date of Patent: Jul. 7, 1998

[54] PENCIL HAVING AN ERASER-HOLDING FERRULE SECURED BY ULTRASONIC WELDING, AND A FERRULE ADAPTED FOR THAT PURPOSE

[75] Inventors: André Coinon, Le Portel-France; Zoltan Trajber, Boulogne Sur Mer, both of France

[73] Assignee: Conte S.A., France

[21] Appl. No.: 677,137

[22] Filed: Jul. 9, 1996

[30] Foreign Application Priority Data

Jul. 17, 1995 [FR] France ..... 95 08831

[51] Int. Cl.[6] ..... B43K 29/02

[52] U.S. Cl. ..... 15/431; 15/427; 401/96; 401/195

[58] Field of Search ..... 15/424–434; 401/96, 401/195

[56] References Cited

U.S. PATENT DOCUMENTS

| | | | |
|---|---|---|---|
| 1,352,677 | 9/1920 | Moore | 15/431 X |
| 1,903,474 | 4/1933 | Reckford | 15/431 |
| 2,099,613 | 11/1937 | Loewus | 15/427 |
| 2,493,665 | 1/1950 | Gagnon | 15/431 |
| 2,785,100 | 3/1957 | Yaw | 156/218 |
| 3,262,425 | 7/1966 | Waugh | 15/431 |
| 4,003,665 | 1/1977 | Drever et al. | 401/259 |
| 5,244,297 | 9/1993 | Bachelet et al. | 401/96 |

FOREIGN PATENT DOCUMENTS

| | | |
|---|---|---|
| 1 106 207 | 5/1961 | Germany . |
| 1 958 391 | 5/1971 | Germany . |
| 2 264 676 | 9/1993 | United Kingdom . |

*Primary Examiner*—Mark Spisich
*Attorney, Agent, or Firm*—Wolf, Greenfield & Sacks, P.C.

[57] ABSTRACT

In a pencil having a central lead, provided at its top end with an eraser mounted in a ferrule fixed on the body of the pencil, both the ferrule and the peripheral body surrounding the lead are made of thermoplastic materials that are compatible, and the bottom of the ferrule is fixed to the top end of the pencil by localized interpenetration of the thermoplastic materials in at least one ultrasonic weld zone. The material of the peripheral body of the pencil is preferably expanded so as to have a relative density of about 0.5 to 0.6, and the top end of the body includes a setback in which the density has been increased, locally. The ferrule includes a shoulder on the outside face of its bottom, the shoulder being annular in shape and forming an energy director for ultrasonic welding.

13 Claims, 1 Drawing Sheet

PENCIL HAVING AN ERASER-HOLDING FERRULE SECURED BY ULTRASONIC WELDING, AND A FERRULE ADAPTED FOR THAT PURPOSE

The present invention relates to a pencil having a central lead and a top end provided with an eraser received in a ferrule. The invention also relates to a ferrule made of a thermoplastic material and specially adapted to serve as a housing for an eraser for fixing to the end of a pencil.

BACKGROUND OF THE INVENTION

Pencils having a central lead made of graphite are sometimes fitted at their non-sharpened end with a small eraser which is held in line with the pencil. This is done by a part referred to as a "ferrule" which enables the pencil and the eraser to be assembled together. In conventional manner, the ferrule is generally made of aluminum, and is cylindrical in shape. Fixing proper is obtained by crimping, i.e. the cylindrical walls of the ferrule are deformed locally in such a manner that the deformations constitute a retention zone both in the pencil and in the eraser.

Although a conventional aluminum ferrule is entirely effective for its purpose, the Applicant finds that it suffers from the drawback of being limited from the point of view of appearance, both because of the deformation imparted by crimping and because of the limited number of shapes and colors available.

The object of the Applicant is to provide a pencil having a central lead which is provided with an eraser end ferrule made of plastics material, the range of colors available for that purpose being unlimited and the outside appearance thereof being capable of taking up any shape possible, particularly if the ferrule is made by molding. It will be understood that a ferrule made of plastics material cannot be fixed to the outside of the body of a pencil at its top end by means of crimping since plastics material does not retain deformation permanently as does aluminum.

Ferrules made of plastics material have already been proposed in which an intermediate partition defines two housings, one for the top end of the pencil and the other for one end of the eraser, with the ferrule being connected to the pencil by means of adhesive. However, the technique of using adhesive suffers from major drawbacks in the context of industrial manufacture, particularly in the event of the manufacturing equipment being stopped. It is also necessary for the ferrule to be secured sufficiently strongly to the end of the pencil to avoid becoming detached therefrom when a certain amount of traction is applied between the pencil and the ferrule while erasure is taking place, and this is not always guaranteed by adhesive.

OBJECT AND SUMMARY OF THE INVENTION

The object of the invention is to provide a pencil having a central lead that is provided at its top end with an eraser housed in a ferrule, and which mitigates the above-mentioned drawbacks.

In characteristic manner, the pencil body and the ferrule are made of compatible thermoplastic materials, and the ferrule is secured to the top end of the pencil by localized interpenetration of said thermoplastics materials, at least in an ultrasonic welding zone.

Pencil type writing instruments having a graphite lead are indeed known, in particular from document EP 0 505 262 that are made by coextrusion of thermoplastic material and in which the "wooden" material constituting the body and surrounding the "lead" material is made of a thermoplastic material.

It is also known, in particular from document GB 2 264 676, that it is possible to use the ultrasonic welding technique for fixing together parts of all kinds, including in the field of writing instruments.

However nothing enables the person skilled in the art to imagine that it will be possible to fix the top end of a pencil to a ferrule of thermoplastic material with sufficient retention force by means of ultrasonic welding. This is achieved firstly by selecting compatible thermoplastic materials for the ferrule and for the pencil body surrounding the lead, and secondly by the interpenetration of the materials in the weld zone. To ensure that retention force is satisfactory, it is necessary for there to be a degree of interpenetration between the materials constituting firstly the ferrule and secondly the peripheral body surrounding the lead.

The thermoplastics materials of the ferrule and of the pencil body are preferably both based on acrylonitrile butadiene styrene (ABS).

By means of the invention, it is possible to make ferrules of any color and of any shape, in particular giving decorative effects such as contrast between the pencil and the ferrule.

It should nevertheless be emphasized that to ensure the retention strength between the ferrule and the pencil is sufficient, it is desirable for the coloring agent content of the thermoplastic material constituting the ferrule to be substantially the same as that of the material constituting the peripheral body of the pencil. Too great a difference in the coloring agent contents of these two elements considerably reduces the retention force.

It has also been observed that retention force between the ferrule and the top end of the pencil can also depend on the density of the thermoplastic material of the peripheral body of the pencil in the ultrasonic welding zone. It is known, in particular from document EP 0 505 262, that the "wood" material surrounding the "lead" is an expanded material. The purpose of such expansion is to obtain a plastic pencil that has substantially the same density as a traditional wooden pencil. It has been observed that the retention force between the ferrule and the expanded material of the peripheral body can be reduced when the material is greatly expanded so as to have a relative density lying in the range 0.5 to 0.6.

To mitigate that drawback, the top end of the peripheral body of the pencil includes a setback, made by compression, for the purpose of locally increasing the density of the expanded material of the peripheral body.

According to the invention, the ferrule in which the eraser is received may be of any appropriate shape, providing it has a contact zone with the thermoplastic material of the outer body that is suitable for constituting an ultrasonic welding zone.

In particular, the ferrule can be constituted in very simple manner to have a cylindrical housing for the eraser which is closed at one end by a transversely-extending bottom. Under such circumstances, the ultrasonic welding zone is situated at the bottom. Thus, unlike aluminum ferrules, there are no cylindrical walls actually surrounding the top end of the pencil.

Nevertheless, for decorative reasons, it may be preferred for the ferrule also to include a cylindrical wall like a traditional ferrule made of aluminum.

Advantageously, under such circumstances, the top end of the pencil body has a setback which is organized so that after the ferrule has been fixed to said end, the outside face of the ferrule is substantially flush with the outside face of the peripheral body of the pencil, whether it is cylindrical or polygonal.

This particular embodiment makes it possible to obtain an original decorative effect in which the outside diameter of the pencil is uniform over its entire length, including over the ferrule.

Another object of the invention is to provide a ferrule specially designed to act as a housing for a pencil eraser as described above.

In characteristic manner, such a ferrule of thermoplastic material is cylindrical in shape with a transverse bottom whose outside face includes a shoulder forming an energy director for ultrasonic welding, said shoulder being situated outside a circular central zone that is designed to be in register with the graphite lead.

It has been observed by the Applicant that even when the lead is made of a graphite-filled thermoplastic material, the presence of the graphite prevents proper retention force being achieved between the pencil and the ferrule during ultrasonic welding. It is therefore essential for the energy-directing shoulder, operating in a manner well known in ultrasonic welding, to be situated outside the zone corresponding to the graphite lead.

The shoulder in question is preferably annular in shape. This makes it possible to obtain a uniformly-distributed weld.

In a preferred version of a shoulder that is annular in shape, the cross-section thereof is symmetrical, having a rectangular portion terminated with a triangularly shaped tip portion. This particular configuration makes it possible to obtain very good penetration of the ferrule constituting material of the annular shoulder in the material constituting the peripheral body surrounding the lead.

In a preferred embodiment, the height of the shoulder is about 1 mm, comprising 0.6 mm for the rectangular portion and 0.4 mm for the triangular tip portion, with the thickness of the shoulder in the rectangular portion being about 0.4 mm.

For a pencil having an outside diameter of about 8 mm, the annular shoulder should have an outside diameter of about 5 mm. In this manner, the annular shoulder which forms an energy director for ultrasonic welding is positioned substantially concentrically about the axis of the pencil, at equal distances from the graphite lead and from the outside face of the peripheral body.

It has also been observed that it is preferable, in a pencil having a graphite lead of given diameter, for the bottom of the ferrule to be provided with a central orifice of diameter greater than the given diameter of said lead. During ultrasonic welding, the thermoplastic materials involved may be subject to creep. The presence of the central orifice makes it possible to retain accurate alignment between the pencil and the ferrule in spite of any such creep, since instead of locally creating excess thickness in the weld zone, the material in question can escape into the central orifice.

Also, and preferably, the ferrule of the invention presents a plurality of uniformly distributed longitudinal grooves on the inside face of the housing for the eraser. The advantage of this embodiment lies in the possibility of using a sonotrode for ultrasonic welding, the sonotrode having a cylindrical endpiece of a diameter appropriate for penetrating in fitted manner in the housing of the ferrule. Thus, positioning of the ferrule on the sonotrode is facilitated by the fact that the ferrule remains locked in position on the endpiece once it has been positioned thereon. The same grooves also have the function of serving as anchor means for retaining the eraser in its housing. The eraser is a force-fit in said housing. The grooves which give rise to local crushing of the eraser prevent it from being withdrawn easily from the ferrule. It can happen that the longitudinal grooves are flattened out in part during ultrasonic welding because of the heating due to the vibration of the sonotrode. However the small amount of flattening involved does not spoil retention of the eraser in the ferrule.

BRIEF DESCRIPTION OF THE DRAWING

The present invention will be better understood on reading the following description of embodiments of a graphite lead pencil fitted with a ferrule for an eraser hat is secured by ultrasonic welding to the top end of he pencil body surrounding the lead, as illustrated in he accompanying drawing, in which.

MORE DETAILED DESCRIPTION

Figure 1:
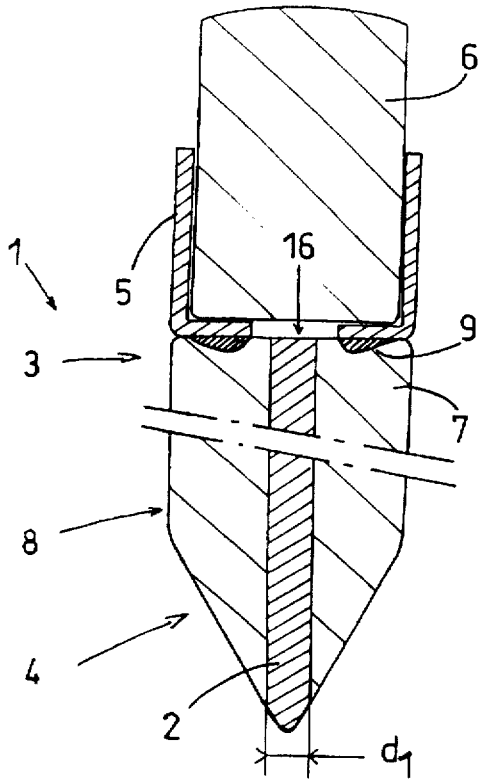
FIG. 1 is a diagrammatic section view of a first embodiment of the ferrule.

The present invention, provides a pencil 1 having a graphite lead 2 which is provided towards its top end 3, remote from its sharpened end 4, with a ferrule 5 serving as a housing for an eraser 6.

In characteristic manner, both the ferrule 5 and the body 7 of the pencil surrounding the graphite lead 2 are made of compatible thermoplastic materials. In particular, they may be made of the same thermoplastic material, such as ABS, or they may be made of two thermoplastic materials having good compatibility, in particular the ferrule may be made of polystyrene and the outer body 7 of the pencil may be made of ABS.

In addition, the ferrule 5 is fixed on the top end of the pencil proper 8 by localized interpenetration of said thermoplastic materials, at least in an ultrasonic welding zone 9.

Figure 2:
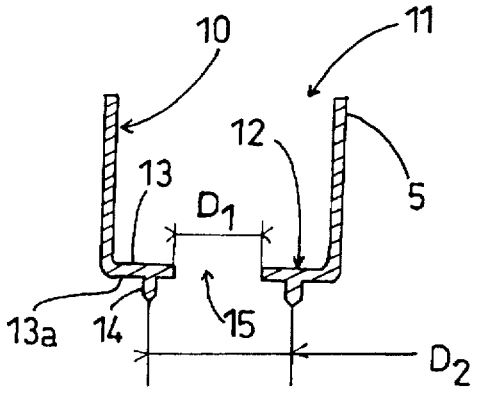
FIG. 2 is a diagrammatic section view of the first embodiment of the ferrule prior to the application of ultrasound.

In the first embodiment shown in FIGS. 1 and 2, the ferrule 5 is constituted by a tubular part 10 having a top end 11 that is open and a bottom end 12 that is closed by a bottom 13 whose outside face **13*a* is provided with an energy director 14 suitable for encouraging ultrasonic welding with the thermoplastic material of the outer body 7 at the top end 3 of the pencil 8**.

In the example shown in FIG. 2, the bottom 13 of the ferrule 5 is pierced by a circular opening 15 of diameter Dl greater than the diameter dl of the graphite lead 2. In addition the energy director 14 is annular in shape having a diameter D2 which is greater than the diameter Dl of the orifice 15.

While ultrasound is being applied, the energy director 14 is applied with constant pressure against the top face 16 of the pencil 8 so that the longitudinal axis of the graphite lead 2 coincides with the axis of symmetry of the ferrule 5. In this position, the energy director 14 is situated in register with the outside body 7 of the pencil 8. The action of the ultrasound causes localized melting of the thermoplastic materials constituting the energy director 14 and the zone of the outside body 7 such as to cause interpenetration between the corresponding thermoplastic materials. After time has been allowed for cooling, the ferrule is secured to the top face 16 of the pencil 8.

The presence of the orifice 15 makes it possible for any creep that may occur in the thermoplastic materials to take place via said orifice 15, such creep preventing localized excess quantities of material accumulating and therefore ensuring that the ferrule 5 is not misaligned relative to the pencil 8.

In the example of FIG. 1, the peripheral face of the pencil 8 is substantially flush with the outside face of the ferrule 5.

It should be observed that the energy director cannot be positioned in a zone facing the graphite lead 2. Even when the graphite lead is itself based on a thermoplastic material that is compatible with the ferrule, it has been observed that the presence of the graphite in the lead prevents the retention that is necessary for achieving good fixing after ultrasonic welding.

It has also been observed that the best retention results are obtained with thermoplastic materials having substantially the same content of coloring agents both in the ferrule 5 and in the outer body 7 of the pencil 8.

Figure 3:
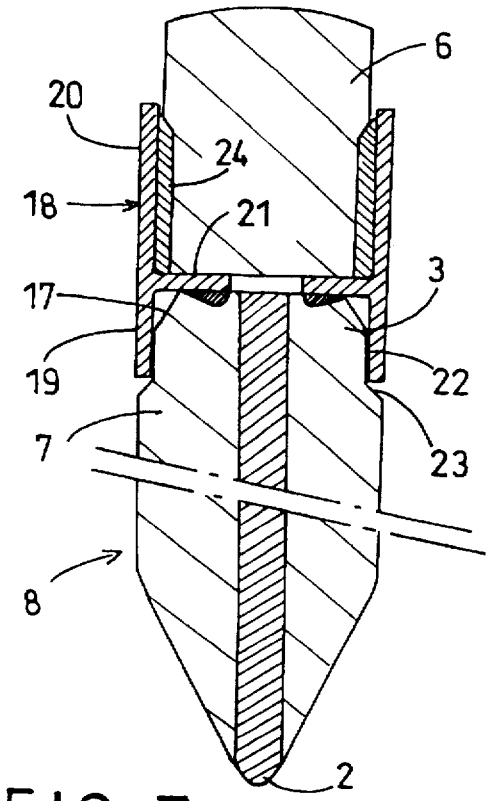
FIG. 3 is a diagrammatic section view of a pencil constituting a second embodiment.
Figure 4:
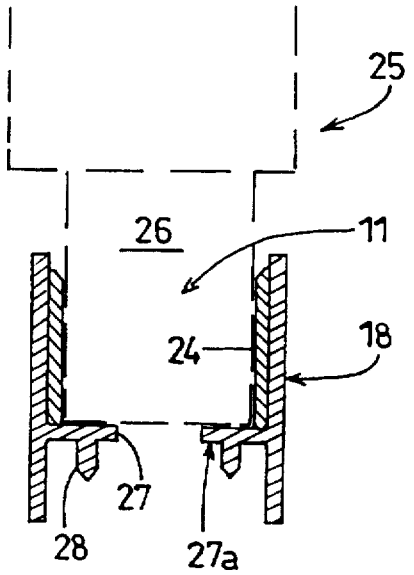
FIG. 4 is a diagrammatic section view of the ferrule of the second embodiment.

The second embodiment shown in FIGS. 3 and 4 has several significant differences compared with the first embodiment.

A first difference lies in the setback 17 situated at the top end 3 of the pencil 8. This setback 17 is obtained by localized compression applied to said top end 3, which compression is achieved, for example, in a heated metal shaper. The shape of the setback 17 is frustoconical in this case.

The advantage of such a setback is that it increases retention force between the ferrule 18 and the outer body 7 of the pencil 8 when the thermoplastic material of said body 7 is expanded to a particularly great extent. The compression generated by forming the setback 17, locally increases the density of said thermoplastic material in the zone which is to form the ultrasonic weld.

The second difference lies in the presence of a skirt 19 which extends the annular upright 20 forming the housing for the eraser 6 in the ferrule 18. The annular skirt 19 performs several functions. It performs an appearance function since it serves to hide the zone where the bottom 21 of the ferrule 18 is connected to the top end 3 of the pencil 8, and in particular it hides any flash that may occur due to creep of the thermoplastic materials in the ultrasonic weld zone.

The skirt 19 also serves to center and align the pencil 8 and the ferrule 18 in the ultrasonic welding installation.

It may optionally have a third function of providing additional fastening when the outside diameter of the pencil towards its top end 3 is slightly greater than the inside diameter of the skirt 19. When ultrasound is applied, the constant pressure between the ferrule 18 and the pencil 8 also gives rise to localized melting of the thermoplastic material constituting the ferrule and the outer body 7 of the pencil 8 in some of the contact zones, e.g. in the zone 22 shown in FIG. 3.

In the example of FIG. 3, the top end 3 of the pencil 8 has a second setback 23 enabling the outer faces of the ferrule 18 and of the pencil 8 to be made accurately flush.

A third difference between the first embodiment and the second embodiment shown in FIG. 3 lies in the presence of longitudinal internal grooves 24 running along the annular upright 20 of the ferrule 18. These uniformly spaced-apart longitudinal grooves 24, e.g. six grooves at 60° intervals, serve two functions. They enable the ferrule 18 to be fitted accurately onto the sonotrode 25 of the ultrasonic welding installation. In this example, the sonotrode 25 has a cylindrical endpiece 26 of dimensions such as to enable the ferrule 18 to be accurately positioned around said endpiece 26 without 20 play. Although heating or even localized melting of the thermoplastic material does indeed take place along one or more of the longitudinal grooves 24 when ultrasound is applied, thereby deteriorating the profile of the groove to some extent, e.g. by flattening it somewhat, 25 nevertheless this deformation is acceptable and does not prevent the longitudinal grooves 24 from performing their second function of holding the eraser 6 in position once it has been forced into the inside housing 11 of the ferrule 18.

The face 27*a* of the bottom 27 of the ferrule 18 is provided with an energy director 28 having the same shape as in the first embodiment. It comprises a shoulder of annular shape and having a cross-section that is symmetrical with one portion adjacent to the face 27*a* of the bottom 27 that is rectangular and with another portion terminated by a triangular tip. Best results have been obtained with a shoulder that is about 1 mm high, comprising 0.6 mm for the rectangular portion and 0.4 mm for the triangular portion, with the thickness of the shoulder also being 0.4 mm. This result has been obtained for a pencil having a diameter of about 8 mm, with an annular shoulder 28 constituting an energy director having a diameter of about 5 mm. Under such conditions, the annular shoulder is situated perceptibly outside the graphite lead 2 in a concentric zone intermediate between the graphite lead and the outside face of the pencil 8.

It should be observed that when the pencil is not circular in section, e.g. being hexagonal in section, it is preferable for the inside diameter of the skirt 19 to be slightly smaller than the greatest outside dimension of the pencil. Under such circumstances, the longitudinal edges of the pencil act as additional zones 22 for ultrasonic welding.

When applying ultrasound at 35,000 Hz, the results obtained have enabled pencils of the invention to be produced in which the force required to tear the ferrule from the pencil proper is at least 7 kg, a value that is generally accepted for bonding between wooden pencils and crimped aluminum ferrules.

Naturally, the person skilled in the art can determine the optimum conditions for applying ultrasound, in particular the frequency thereof and the pressure that needs to be exerted between the ferrule and the pencil in order to obtain the required interpenetration of the thermoplastic materials constituting the ferrule and the outer body of the pencil.

In addition, the invention is not limited to the embodiments described as non-exhaustive examples. In particular, the shape of any setbacks, the shape and the color of the ferrule, and the shape of the energy director(s) can vary within the ambit of the present invention.

We claim:

1. A pencil, comprising:

a body, a ferrule, and an eraser;

the ferrule including a top end and a bottom end;

the body including a top end, and a peripheral body surrounding a central lead extending therefrom;

wherein the eraser is mounted in the top end of the ferrule; and wherein the peripheral body and the ferrule are made of compatible thermoplastic materials, and the bottom end of the ferrule is fixed to the top end of the body by localized interpenetration of the thermoplastic materials in at least one zone by ultrasonic welding.

2. A pencil according to claim 1, wherein the ferrule and the peripheral body are the same thermoplastic material.

3. A pencil according to claim 1, wherein the thermoplastic materials constituting the ferrule and the peripheral body have the same content of coloring agent.

4. A pencil according to claim 1, wherein the thermoplastic material of the peripheral body is an expanded material having a relative density in the range of about 0.5 to 0.6, and wherein a top end of the peripheral body includes a setback in which the density has been locally increased.

5. A pencil according to claim 1, wherein the ferrule includes a peripheral skirt extending beyond a bottom of an annular upright, and wherein the top end of the body has a setback organized so that after the ferrule has been secured on the top end by welding, an outside face of the skirt lies substantially flush with an outside face of the body.

6. A pencil according to claim 1, comprising a diameter of about 8 mm, wherein an annular shoulder of the ferrule has an outside diameter of about 5 mm.

7. A pencil according to claim 1, wherein the ferrule and the peripheral body comprise the thermoplastic ABS.

8. A ferrule made of a thermoplastic material and suitable for serving as an eraser housing for a pencil, the pencil comprising a central lead and a peripheral body surrounding the central lead, the peripheral body comprising a thermoplastic material, wherein the thermoplastic material of the ferrule and the peripheral body are compatible, the ferrule including a bottom having an outside face, the outside face including a shoulder for directing energy for ultrasonic welding.

9. A ferrule according to claim 8, wherein the shoulder is annular in shape.

10. A ferrule according to claim 9, wherein the shoulder is symmetrical in cross-section, having a rectangular portion terminated by a triangular tip portion.

11. A ferrule according to claim 10, wherein the shoulder has a height of about 1 mm, and a thickness of about 0.4 mm, and wherein the rectangular portion has a height of about 0.6 mm and the triangular tip has a height of 0.4 mm.

12. A ferrule according to claim 8, further comprising an orifice disposed centrally about and having a diamater greater than the central lead.

13. A ferrule according to claim 8, further comprising a peripheral upright having longitudinal centering grooves on an inside face.

* * * * *